United States Patent [19]

Patterson et al.

[11] 4,296,499

[45] Oct. 27, 1981

[54] BLISTER PREVENTING FOOT COVER

[75] Inventors: Theodore P. Patterson, 5207 Twilight La., Fort Wayne, Ind. 46815; Stephen E. Winner, Fort Wayne, Ind.

[73] Assignee: Theodore P. Patterson, Fort Wayne, Ind.

[21] Appl. No.: 43,459

[22] Filed: May 29, 1979

[51] Int. Cl.[3] ..... A41B 11/00

[52] U.S. Cl. ..... 2/239; 36/9 A

[58] Field of Search ..... 2/239, 61; 36/9 A, 9 R, 36/10; 161/109

[56] References Cited

U.S. PATENT DOCUMENTS

| | | | |
|---|---|---|---|
| 2,038,844 | 4/1936 | Le Dorf | 2/61 A |
| 2,714,771 | 8/1955 | Olfene | 36/9 A |
| 3,229,875 | 1/1966 | Stoller | 2/239 |
| 3,619,339 | 11/1971 | Garrett | 161/109 |

FOREIGN PATENT DOCUMENTS

| | | | |
|---|---|---|---|
| 1444096 | 5/1966 | France | 2/239 |

*Primary Examiner*—H. Hampton Hunter
*Attorney, Agent, or Firm*—Gust, Irish, Jeffers & Hoffman

[57] ABSTRACT

A foot covering article adapted to be worn over the bare foot and directly underneath a sock for the purpose of preventing the formation of blisters when engaging in athletic activities and the like. The article is made of a single, porous, non-woven film-fibril sheet of plexifilamentary strands, wherein the sheet is consolidated by a large number of very small point bonds, and includes a plurality of minute perforations extending through the thickness of the sheet. The sheet is formed into a foot enveloping shape comprising a bottom portion which covers the sole of the wearer's foot, side portions extending upwardly from the bottom portion, a heel portion which covers the heel of the wearer's foot, and a front portion which covers at least the forward portion of the top of the wearer's foot. The article has a smooth inner surface so that there is minimal friction between the wearer's foot and the article, and an outer surface which is rough, relative to the character of the inner surface, so that stability between the article and either the sock or shoe which is adjacent thereto is enhanced. An important property of the sheet material is that the degree of friction which is present between it's inner surface and the wearer's foot decreases as the material is repeatedly crumpled. Thus, the blister preventative character of the article increases with use.

5 Claims, 5 Drawing Figures

BLISTER PREVENTING FOOT COVER

BACKGROUND OF THE INVENTION

The present invention relates to a foot covering article adapted to prevent or decrease the occurrence of blisters on the feet of people engaging in athletic activities, and the like, and to the method for using the article in this manner.

A persistent problem encountered by all persons engaging in athletic endeavors such as jogging, tennis, raquetball, basketball, etc., which involve running, jumping or rapid starting and stopping actions, is the formation of blisters on the feet. This problem is particularly acute in the case of persons who have not engaged in such athletic endeavors for a period of time and whose feet are soft and uncalloused. The constant rubbing between the bare feet and socks, which are normally worn underneath athletic shoes, breaks down the skin and produces blisters. Often, blisters will be formed in a very short period of time thereby forcing the participant to terminate prematurely the activity.

Even persons who regularly engage in athletic activities and whose feet are toughened and well conditioned can experience the formation of painful blisters. This is often caused by a wrinkle in the sock or by a ridge in the lining of the shoe, which produces localized pressure and friction thereby causing the skin to break down and a blister to be formed. Of course, the first time new shoes are worn often results in the formation of blisters because the feet have not yet formed the shoe to the point that there is a satisfactory fit.

Although blisters on the feet can be treated with medications to prevent infection and alleviate the pain, only a relatively prolonged healing period, during which no athletic activity involving strenuous use of the feet is engaged in, can repair the damage. Obviously, there is a great need for an article or technique which can prevent the blisters from forming in the first place.

SUMMARY OF THE INVENTION

It has been discovered that a sheet product manufactured by E. I. du Pont de Nemours and Company of Wilmington, Delaware and marketed under the trademark TYVEK, when formed into a sock-like article shaped so as to envelop the sole, heel, sides and at least the forward portion of the top of the foot, is extremely successful in preventing blisters when worn between the bare foot and underneath a sock and shoe. The sheet material has a smooth surface on one side with a rougher surface on the other side and tends to cling to the foot, due to the presence of moisture on the surface of the foot resulting from perspiration, so as to form a loose "second skin".

The sheet material is formed into a foot cover such that the smooth surface forms the inside of the cover and the rougher side will be next to the sock. Although the inner surface of the cover tends to cling to the moist foot, there will be a certain amount of slippage between it and the foot. Since the inner surface is very smooth and produces little friction as it rubs the foot, the slippage which occurs will not produce blisters, as would be the case when wearing a sock directly next to the foot. Although the outer surface of the cover is much rougher than the inner surface, it is still capable of sliding easily within the sock, thereby providing a bearing surface for the normal relative movement between the shoe and the foot that occurs when running, jumping or starting and stopping quickly. It is important, however, that the amount of friction between the cover and the overlying sock not be reduced to the point that there is instability between the foot and the shoe. This would give the person wearing them the feeling of running in shoes having a slippery substance, such as grease or oil, on the inner surfaces, and would result in a lack of control when starting or stopping suddenly. The rough outer surface, then, is necessary so that the relative movement between the shoe and foot, which occurs when stopping or starting suddenly, for example, is taken up both by the interface between the outer surface of the cover and the sock and by the interface between the inner, smooth surface of the cover and the bare foot.

In order to provide both stability and an effective blister preventing shield, it is necessary that the cover be constructed so as to enclose nearly the entire foot, and at least the entire sole, sides, lower heel portion and the forward portion of the top of the foot. The mere application of blister preventing pads or the like to localized areas of the foot, even though these may be the areas where blisters most often occur, is not satisfactory for preventing blisters and will not produce the good stability and natural feeling produced by the foot cover of the present invention, which envelops the entire foot so as to form a "second skin" that provides two sliding interfaces, one between the outer surface of the cover and the overlying sock and the other between the inner surface of the cover and the foot.

An important property of this material which has been discovered is that, the more it is crumpled, the lower the degree of friction produced between it and the bare foot, and it becomes more "slippery" relative to the foot. Thus, the cover is more effective for preventing blisters the longer it is used. In order to obtain the benefits of continued use when the cover is first used, it may be crumpled before wearing.

Specifically, the present invention is a foot covering article adapted to be worn between the bare foot and a sock for the purpose of preventing the formation of blisters. The article comprises one or more porous, non-woven film-fibril sheets of plexifilamentary strands wherein the sheet or sheets have about 200–800 point bonds per square inch comprising about 5 to 10 percent of the planar area of the sheet or sheets, and a plurality of minute perforations extending through the thickness of the sheet or sheets with the total cross-sectional area of the perforations being at least 3 percent of the planar area of the sheet. The sheet or sheets are formed into a foot enveloping shape comprising a bottom portion adapted to cover the sole of the wearer's foot in use, side portions extending upwardly from the bottom portion when in use, a heel portion adapted to cover the heel of the wearer's foot in use, and a front portion adapted to cover a least the forward portion of the top of the wearer's foot when in use. The article has an inside adjacent the wearer's foot when in use and an outside, and the sheet or sheets have a smooth inner surface forming the inside of the article and a relatively rough outer surface forming the outside of the article.

The present invention also contemplates a method for the prevention of blisters on the feet when engaging in athletic activities and the like comprising wearing on each foot directly in contact therewith and directly underneath an overlying sock a foot cover as defined above. The cover has the property that the inner surface thereof has a coefficient of friction relative to the bare foot which decreases when the cover is repeatedly crumpled and a preferred form of the method includes the step of crumpling the cover prior to wearing it so as to reduce the friction of the contact between it and the foot.

DETAILED DESCRIPTION

Figure 1:
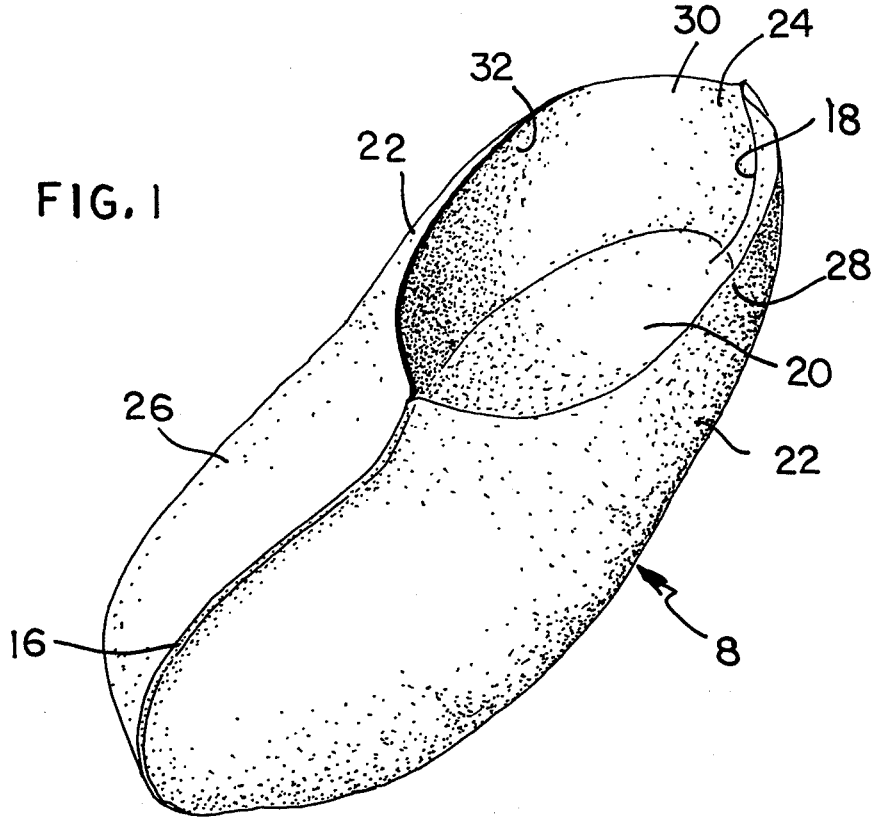
FIG. 1 is a perspective view of the foot cover according to the present invention in the unfolded, open state it assumes when in use.

As discussed above, the foot cover according to the present invention is made of a commercially available, non-woven sheet material manufactured by E. I. du Pont de Nemours and Company of Wilmington, Delaware and marketed under the trademark TYVEK. This material is described in U.S. Pat. No. 3,619,339, and this patent is expressly incorporated herein by reference.

As disclosed in U.S. Pat. No. 3,619,339, the basic material for the sheet material is a non-woven plexifilamentary film-fibril sheet structure wherein the plexifilaments are prepared from synthetic filament-forming polymers for polymer mixtures as, for example, polyethylene. The sheet is formed by first spinning continuous strands of very fine, interconnected fibers and then bonding them together with heat and pressure. The particular TYVEK material which is being used for the foot cover of the present invention is Type 1658 which is described in greater detail in DuPont Technical Information Bulletin TK-3, Dec. 1978.

The film-fibril sheet is consolidated in a direction normal to the plane of the sheet by compaction, and this sheet is then modified by point-bonding and perforating so as to produce a porous, strong, fabric-like material suitable for fabrication into the desired article.

The point-bonding may be carried out by the general method disclosed in U.S. Pat. No. 3,478,141 whereby the starting, non-woven material is passed between the nip of two rolls, with one roll having a heat-conductive surface with about 200 to 800 hard bosses per square inch of roll surface, wherein the bosses extend radially from the surface of the roll by about 0.020 in., or at least about 2.5 times the thickness of the sheets being treated. The total area of the tips of the bosses is equivalent to about 5 to 15 percent of the planar area of the sheet, and the opposing roll has a resilient surface with a Durometer hardness between 60 and 90. Sufficient heat is provided through the heat-conducting roll and sufficient pressure is provided between the rolls to form point-bonds (translucent windows) with the remaining area of the sheet remaining essentially unaffected.

The point-bonded area should be maintained between 5 and 10 percent to maintain strength properties at satisfactory levels. If the point-bond area exceeds about 10 percent in perforated sheets, the sheet may become excessively stiff and papery.

As mentioned above, the sheet material is also perforated so that it has an open, or perforated, area of at least 3 percent, although open areas up to about 6 percent or even 10 percent are preferred. It is preferred that the sheet have a Frazier porosity of about 40 $ft^3/ft^2/min$.

The perforating step may be carried out in a number of ways, such as by a conventional needle loom or a rotary pin perforator. At least 500 perforations should be placed into each square inch of the sheet material, and that the perforations be provided by separating film-fibril elements of the sheet less than about 0.021 in. An exemplary thickness for the sheet material is 0.18 mm.

Figure 2:
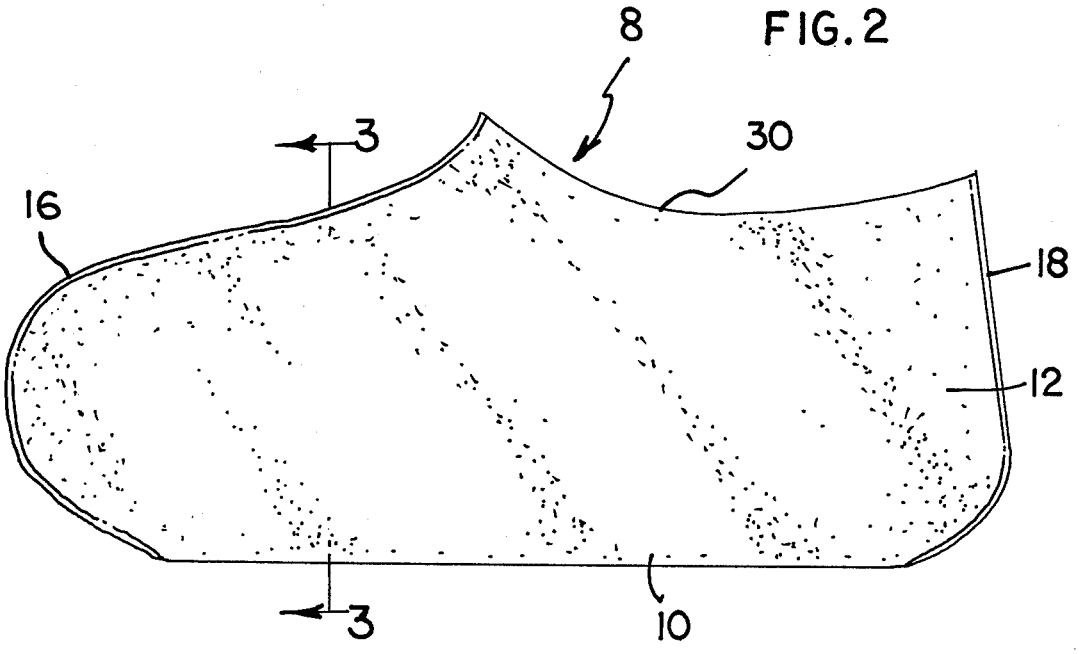
FIG. 2 is an elevational view of the foot cover of FIG. 1 in almost its completely flat, closed state.
Figure 3:
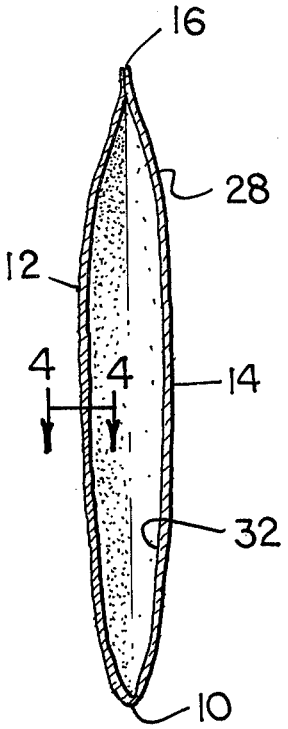
FIG. 3 is a sectional view of FIG. 2 taken along line 3—3 and viewed in the direction of the arrows.

Referring now to the drawings, the foot cover 8 according to a preferred embodiment of the invention comprises a single sheet of the above-identified film-fibril material which is adapted to lie flat in storage, as illustrated in FIGS. 2 and 3. The sheet of material is creased at 10 so that it's halves 12 and 14 match up, and is then heat bonded together along edges 16 and 18. The heat bonding is achieved by means of a heated wire in the shape of the perimeter of cover 8, which is pressed against the folded halves 12 and 14.

In order to place the cover 8 on the foot (not shown), it must first be opened to the shape shown in FIG. 1. When opened in this manner, it comprises a bottom portion 20, only a minor portion of which includes bonded edges 16 and 18, side portions 22 extending upwardly from bottom portion 20, heel portion 24 which is adapted to cover the heel of the wearer's foot, and a front portion 26 which, in the case of the preferred embodiment illustrated, is sufficient to cover nearly the entire top portion of the wearer's foot. An advantage to the manner in which foot cover 8 is formed is that the bottom portion, which is subject to the greatest amount of pressure and friction due to the fact that it contacts the sole of the wearer's foot, is almost completely of integral construction without the seams along edges 16 and 18. It should be noted that the bonded seams along edges 16 and 18 are formed on the outer surface 28 of cover 8 so that the portion of the seams presented to the wearer's foot are jointed without any overlap internally of the cover 8.

The cover 8 is preferably designed such that one size will fit a wide range of foot sizes. Furthermore, the opening 30 in the cover should be sufficiently large to avoid constricting the wearer's leg.

Figure 4:
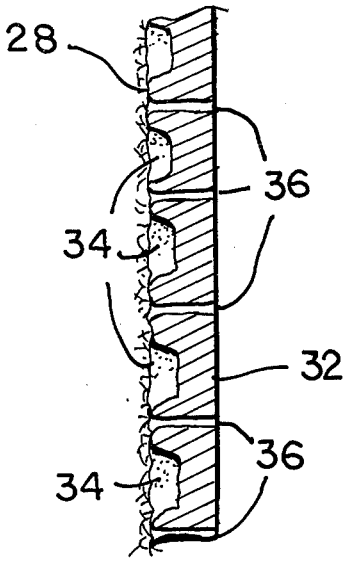
FIG. 4 is a sectional view of FIG. 3 taken along line 4—4 and viewed in the direction of the arrows.
Figure 5:
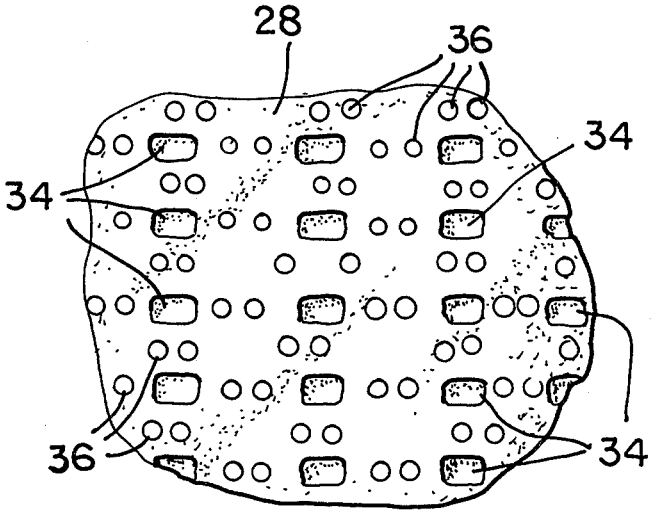
FIG. 5 is an enlarged, fragmentary, schematic view of the outer surface of the foot cover.

FIGS. 4 and 5 are schematic illustrations of the structure of the film-fibril sheets and it will be seen that the inner surface 32 is essentially flat and smooth whereas the outer surface 28 is rough, due in great part to the presence of indentations 34, which are the points at which the point-bonding has occurred. As stated in the introductory portion of the specification, the flat, inner surface 32 is important from the standpoint of reducing the amount of friction between the foot cover 8 and the bare foot of the wearer, and that the rougher outer surface 28 is important to limit the amount of slippage between the foot cover 8 and the overlying sock (not shown) in use. If the slippage between the foot cover 8 and sock is too great, there is a loss of stability in running, and starting and stopping suddenly. The difference in the texture of inner surface 32 and outer surface 28 is of the utmost importance. It has been found, for example, that in cases where the sides are reversed so that the rough outer surface 28 was adjacent the wearer's foot, blisters developed. When the smooth, inner surface 32 is next to the wearer's foot, on the other hand, the formation of blisters is prevented. In order to impart porosity to the sheet material, it is provided with perforations 36, which extend completely through the material.

A property of the film-fibril material discussed above is that, when it is repeatedly crumpled, the inner surface 32 becomes more "slippery", thereby indicating a reduction in the coefficient of friction. Thus, with continued use, the foot cover actually becomes more effective in preventing the formation of blisters. In order to obtain the benefits of this property of the material the first time the foot cover aid is worn, it should be crumpled repeatedly before placing it over the foot. The film-fibril material is washable so that the foot cover can be used repeatedly before being discarded.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A method for the prevention of blisters on the feet comprising:

providing a foot cover made of one or more porous, non-woven film-fibril sheets of plexifilamentary strands, said strands having about 200 to 800 point bonds per square inch comprising about 5 to 10 percent of the planar area of the sheet or sheets, and a plurality of minute perforations extending through the thickness of the sheet or sheets with the total cross-sectional area of the perforations being at least 3 percent of the planar area of the sheet or sheets, said sheet or sheets being formed into a foot enveloping shape comprising a bottom portion adapted to lie underneath the sole of the foot, side portions extending upwardly from the bottom portion and adapted to cover the sides of the foot, a heel portion adapted to cover the heel of the foot, and a front portion adapted to cover at least the forward portion of the top of the foot, said cover having a relatively smooth inner surface and a relatively rough outer surface; and placing and wearing the foot cover on the foot directly in contact with the foot and directly underneath an overlying sock such that the smooth inner surface contacts the foot and clings to it and prevents the formation of blisters and the relatively rough outer surface engages the sock and provides some stability with the overlying sock.

2. The method of claim 1 including the step of crumpling the cover prior to wearing it so as to reduce the friction of the contact between the foot and the inner surface of the cover.

3. The method of claim 1 wherein the cover consists essentially of a single said sheet having edges which are bonded together to form the front and heel portions thereof.

4. The method of claim 3 wherein the side portions and major portion of the bottom portion are integral.

5. The method of claim 1 wherein the sheet or sheets have the property that the inner surface has a coefficient of friction which decreases when the sheet or sheets are repeatedly crumpled, and including the step of crumpling the cover prior to wearing it so as to reduce the friction of the contact between the foot and the inner surface of the cover.

* * * * *